US006889587B2

(12) United States Patent
Neal

(10) Patent No.: US 6,889,587 B2
(45) Date of Patent: May 10, 2005

(54) DIE CUTTER BLANKET

(75) Inventor: Kenneth Ray Neal, Magnolia, TX (US)

(73) Assignee: Robud, Pine Brook, NJ (US)

( * ) Notice: Subject to any disclaimer, the term of this patent is extended or adjusted under 35 U.S.C. 154(b) by 0 days.

(21) Appl. No.: 10/454,560

(22) Filed: Jun. 4, 2003

(65) Prior Publication Data

US 2004/0244556 A1 Dec. 9, 2004

(51) Int. Cl.[7] ..... B26D 7/20
(52) U.S. Cl. ..... 83/347; 83/659; 83/694.42
(58) Field of Search ..... 83/347, 659, 698.42; 492/56

(56) References Cited

U.S. PATENT DOCUMENTS

| | | | | |
|---|---|---|---|---|
| 3,282,142 | A | 11/1966 | Sauer | |
| 3,522,754 | A | 8/1970 | Sauer | 83/659 |
| 3,739,675 | A | 6/1973 | Duckett et al. | 83/659 |
| 3,765,329 | A | 10/1973 | Kirkpatrick et al. | 101/415.1 |
| 3,885,486 | A | 5/1975 | Kirkpatrick et al. | 83/659 |
| 4,073,207 | A | 2/1978 | Kirkpatrick | 83/659 |
| 4,073,208 | A | 2/1978 | Kirkpatrick | 83/659 |
| 4,075,918 | A | 2/1978 | Sauer | 83/659 |
| 4,191,076 | A | 3/1980 | Bollmer et al. | 83/13 |
| 4,289,055 | A | 9/1981 | Von Schriltz | 83/659 |
| 4,791,846 | A | 12/1988 | Kirkpatrick | 83/659 |
| 4,848,204 | A | 7/1989 | O'Connor et al. | 83/659 |
| 4,867,024 | A | 9/1989 | Cho et al. | 83/659 |
| 5,076,128 | A | 12/1991 | O'Connor et al. | 83/659 |
| 5,078,535 | A | 1/1992 | Kirkpatrick | 403/339 |
| 5,515,757 | A | 5/1996 | O'Connor et al. | 83/347 |
| 5,551,340 | A | 9/1996 | Bolza-Schunemann et al. | 101/395 |
| 5,720,212 | A | 2/1998 | Kirkpatrick | 83/659 |
| 5,732,630 | A | 3/1998 | Puschnerat et al. | 101/415 |
| 5,758,560 | A | 6/1998 | Fiscus | 83/659 |
| 5,906,149 | A | 5/1999 | Montenegro Criado | 83/659 |
| 5,916,346 | A | 6/1999 | Neal | 83/659 |
| 6,116,135 | A | 9/2000 | Wagner | 83/698 |
| 6,132,845 | A | 10/2000 | Heinzlreiter | 428/156 |
| 6,135,002 | A | 10/2000 | Neal | 83/659 |
| 6,435,069 | B1 | 8/2002 | Kirkpatrick, Jr. et al. | 83/698 |
| 6,629,482 | B2 * | 10/2003 | Elia et al. | 83/659 |
| 6,668,694 | B2 * | 12/2003 | Neal et al. | 83/347 |
| 2002/0088328 | A1 | 7/2002 | Porcella | |
| 2002/0189419 | A1 | 12/2002 | Ella et al. | |
| 2003/0041714 | A1 | 3/2003 | Neal | |

* cited by examiner

*Primary Examiner*—Kenneth E. Peterson
(74) *Attorney, Agent, or Firm*—Carella Byrne et al.; John G. Gilfillan, III; William Squire

(57) ABSTRACT

A first layer of urethane sheet material is molded with a plurality of interlocking male and female fingers at opposing blanket ends and which fingers form a projection for insertion into an anvil channel. The fingers are arrayed in a plane beneath the plane of the first layer. The abutting ends of the blanket above the fingers form a seam of different configuration than the fingers, e.g., linear, to minimize formation of flat spots on the work surface. A fabric is bonded to the underside of the sheet material in one embodiment or a second layer of urethane is molded to blanket underside to form a major portion of the fingers and the projection in a second embodiment. The second layer has a relative durometer that is harder than the first layer, and a shrinkage smaller than that of the first layer to minimize the formation of edge curl.

28 Claims, 7 Drawing Sheets

DIE CUTTER BLANKET

This invention relates to die cutter blankets used to cover anvils in a sheet material die cutting apparatus.

Of interest is commonly owned copending application Ser. No. 09/942,240 filed Aug. 29, 2001 in the name of Kenneth Ray Neal et al.

Die cutter blankets are thermoset molded urethane material that wrap about steel circular cylindrical anvils. The anvils typically have a channel in the surface thereof extending along the anvil longitudinal axis about which the anvil rotates. The blankets typically have interlocks at abutting edges. Some embodiments include interlocking projections which depend into the anvil channel. The blankets are sheet material with opposing end edges at which the interlocking projections are located. The ends are complementary with the locking projections engaging when inserted into the channel. The locking projections interlock with each other, locking the blanket to the anvil and preclude the blanket from rotating about the anvil.

These blankets are used with die cutting machines wherein a work piece is passed between the anvil-blanket arrangement and a die cutting roller. The dies on the die cutting roller pass through the work piece in different orientations to form products from flat sheet material such as corrugated sheets and so on. The sheet material is later folded to form a box or other product.

A continued problem with the die cutting blankets is unusual wear that tends to cause defective cuts in the sheet material. Such unusual wear is often flat spots at the interlock region where the ends of the blanket abut. This region is where projections depend into the anvil channel providing increased thickness to the blanket at this region. That increased thickness is believed to be a primary cause of premature wear. Flat spots develop in this region due to such projections. Also interdigitated fingers for locking the blanket ends together also may be used. These fingers can also be the source of cutting problems with cutting the blank material.

U.S. Pat. No. 3,765,329 discloses a blanket with projections which engage the rotary anvil channel. The plastic blanket has a sheet metal inner liner. The locking projections form a two part snap in construction in which a female part receives a male part, the female part depending from the blanket at one end edge thereof with a longitudinal rounded groove and the male part is complementary to the groove and snaps into the groove. The male part may be made of metal. The female part has a metal support. The male and female parts depend from the blanket edge for insertion into the anvil channel.

Other complementary locking structures are shown in U.S. Pat. Nos. 4,848,204, 3,885,486, 4,867,024, 5,078,535 and 5,758,560. All of the above patents use interlocking complementary depending structures which fit into the anvil channel and cooperate with each other and the anvil channel to lock the blanket ends together.

Another locking arrangement for locking blanket ends together employs interlocking interdigitated fingers which are somewhat dovetail in shape. U.S. Pat. Nos. 4,075,918, 4,791,846, 6,116,135 and 3,577,822 and U.S. Publications Nos. 2002/0189419 and 2003/0041714, the latter being commonly owned with the present application, disclose this type of interlocking arrangement for use with a die cutter blanket. The interlocking fingers are in the same plane as the blanket sheet material and overlie the anvil. The interlocking fingers, in some embodiments, may overlie the channel. The blanket interlocking finger end portions or other portions of the blanket have a depending projection which fits within the anvil channel to preclude the blanket from rotating relative to the anvil. The blanket is generally of uniform thickness except for the depending projections which add considerable thickness to the blanket at the anvil channel. The blanket is formed of molded urethane and in some embodiments is supported by a metal liner or a woven nylon or fiberglass fabric. The blanket thus comprises two materials, urethane forming the blanket structure and the support woven fabric or metal liner to which the blanket is molded.

A problem with the interdigitated finger construction overlying a thickened depending projection that lies in the anvil channel is that the blanket eventually exhibits a recessed flat portion over the anvil channel during use. This recessed flat portion creates a problem with the sheet material product die cut by the apparatus. The die cutters cut into the sheet material being die cut, typically corrugated or pressed cardboard. The cutters also cut somewhat into the blanket. Because of the resiliency of the blanket material the blanket wears uniformly except at the anvil channel and depending projection which results in the recessed flat portion. Because of this recess flat portion, the dies eventually do not cut uniformly through the blank sheet material at this location causing the premature production of poor product. The recessed portion does not permit the dies at this location to cut cleanly through the product sheet material. The copending application 2003/0041714 noted above provides one solution to this problem.

In that application, the inventors attribute the recessed flat portion to the greater thickness of the urethane material at the projection region depending into the anvil channel. They recognize one source of the problem.

However, the present inventor recognizes further problems with interdigitated finger interlocks in the die cutter blankets. These problems include flat spots over the fingers, scrap hangup and finger breakage. For the finger lock to work, the fingers must extend further on one side of the lock section than on the other side.

When the blanket is mounted on the anvil cylindrical surface, the top surface of the urethane blanket material needs to be curved. A portion of the fingers tend to be linear, extending flat, and do not follow the curvature of the anvil. The fingers, when remaining flat, tend to protrude from the curved surface of the blanket. As a result, small sections of the work product material to be die cut on such a blanket are not cut cleanly. As the fingers are worn, the surface may conform to the arc of the anvil. As the blanket is continuously exposed to further cutting actions, the fingers wear, and a flat spot may develop in this region due to repetitive cutting of the protruding finger material in this region.

This is believed caused by having too much urethane in the mounting slot in the anvil. Too much urethane acts as a spring relative to the rest of the blanket. The spring absorbs the cutting knives of the dies to the extent obtaining clean cuts in the blank material being processed becomes a problem. The operator then compensates for this problem by increasing pressure on the cutter dies. As the pressure is increased, the flat spots tend to occur. This problem is exaggerated in the presence of interdigitated fingers. Also, such fingers tend to curl when the cutting dies cut into them during product processing.

Another problem observed is that as the cutting dies repetitively cut into the same region of the blanket, the cuts forming grooves in the surface of the blanket. The repetitive cutting forms the cut portions of the corrugated paper board material into dust, which is impacted into these grooves by the cutting dies during repetitive cutting action. This impacting action tends to elongate the blanket so that it becomes loose and unsatisfactory for processing product. When the blanket is initially installed it exhibits tension. This tension decreases over time during use. This results in having to replace the blankets more frequently than otherwise, resulting in undesirable down time and added cost.

Another problem observed by the present inventor is edge curl on the blanket surface. This is not desirable. This curl is believed due to tension in the blanket resulting from shrinkage during cooling. Blankets are ground on their external surfaces to make the blanket sheet material of uniform thickness and to remove surface blemishes.

According to the present invention, certain of the above problems are minimized by a die cutter blanket for use with an anvil having an axially extending channel in the surface thereof comprising a plastic sheet member blanket having first and second ends, the blanket for wrapping about the anvil and having an outer peripheral work surface defined by a longitudinal edge which extends about the anvil when wrapped and a transverse edge. The first and second ends each have an end surface at and depending from the peripheral work surface at the transverse edge, the first and second end surfaces being arranged to abut when the blanket is wrapped about the anvil.

A plurality of complementary interlocking fingers at the first and second ends are located in a region spaced from and beneath the outer peripheral work surface at the end edges and together form a projection depending from the blanket for selective interlocking engagement with each other to secure the blanket to the anvil, the projection for engaging the channel.

As a result, the outer work surface of the blanket does not have any exposed fingers which may cause the flat spots as discussed above. The outer work surface only has smooth surfaces terminating at an abutting edge of each end of the blanket. The fingers interlock in a different plane located beneath the plane of the blanket layers.

In one aspect the blanket and fingers are urethane.

In another aspect, the fingers on the first end form a female projection portion and the fingers on the second end form a male projection portion.

In another aspect, the outer peripheral work surface is roughened. This aspect removes surface blemishes. The different hardness and shrinkage of the two layers tend to flatten the blanket surface and also reduces the tension in the blanket eliminating edge curl and the resulting grinding step. The reduced tension facilitates installation of the blanket on the anvil by making it easier to bend the blanket about the anvil during installation as compared to steel liners.

In another aspect, the blanket outer work surface is roughened by forming it with a plurality of indentations created by shot peening the mold forming the outer work surface.

In an alternative aspect, a woven sheet support member is formed with the molded thermoplastic layer at a blanket surface opposite the outer peripheral work surface.

In another aspect, the blanket comprises overlying first and second plastic sheet members of different durometers, the first member forming the outer work surface and the second member together with the first member forming complementary projections at the first and second ends, the second member being formed of harder durometer than the first member and forming an inner liner support member juxtaposed with the first member and outer peripheral work surface.

In another aspect, the sheet support member and projection are formed of the same material, but harder durometer than the blanket sheet member forming the outer peripheral work surface.

In another aspect, the projection is in friction fit with the anvil channel in the channel width direction for locking the projection in the channel.

In another aspect, the blanket has a longitudinal length, the projection in the direction of the length has a dimension greater than the channel width dimension thus forming a friction fit.

In another aspect, the male and female combined projection dimension is at least about 1 mm (0.040 inches) greater than the channel transverse width dimension to provide the friction fit.

In another aspect, the fingers are uniformly spaced from the outer peripheral work surface In another aspect, the blanket has an under side opposite the outer peripheral work surface, the blanket including a linear projection depending from the first end at the underside, the female fingers extending longitudinally from the linear projection a distance spaced from the plane of the underside.

In another aspect, the female first end has a linear projection depending therefrom extending across the width of the blanket, the female fingers extending from the projection in an array to form an L-shaped projection in side profile.

In another aspect, the male fingers engage the female fingers to form a solid projection depending from the blanket surface on a side opposite to and beneath the outer peripheral work surface.

In another aspect, a die cutter blanket for use with an anvil having an axially extending channel of a given transverse width dimension in the surface thereof comprises a plastic sheet member blanket having an outer peripheral work surface and forming a first layer exhibiting edge curl at the longitudinal edges and having first and second ends terminating in first and second transverse edges, the blanket for wrapping about the anvil, the outer peripheral work surface defined by a longitudinal edge which extends about the anvil during the wrapping.

A second layer of different shrink characteristics than the first layer is molded to the first layer. The second layer exhibits relative stress to the first layer which stress minimizes the edge curl in the first layer work surface.

An interengaging locking structure is molded one piece and integral with the first and second layers and secured to the first and second ends for securing the ends together and for securing the blanket to the anvil. The locking structure is located spaced from the outer work surface.

In another aspect, the work surface is formed by a mold whose surface is shot peened to produce a rough work surface finish on the blanket to minimize blemishes in the work surface.

In another aspect, the mold forming the blanket work surface is shot peened with 19.8 mm (0.78 inch) diameter steel shot followed by 15.2–20.3 mm (0.6–0.8 inch) glass shot at 7 kg/cm$^2$ (100 psi) to remove sharp edges.

A die cutter blanket for use with an annular rotating anvil having an axially extending channel of a given transverse width dimension in the surface thereof in a further aspect comprises a first plastic sheet member blanket having first and second ends, the blanket for wrapping about the anvil and having an outer peripheral work surface defined by a longitudinal edge which extends about the anvil during the wrapping and a transverse edge at each of said first and second ends, the outer sheet member having an inner surface.

A second plastic sheet member having first and second ends is included. The second sheet member is attached to the inner surface of the outer sheet member for reinforcing and supporting the outer member on the anvil during die cutting a product on said work surface, the second sheet member being formed of a harder plastic material than the outer sheet member.

A female locking element depends from the first end of the second sheet member and a male locking element depends from the second end of the second sheet member, the male and female elements for interlocking engagement and for securing the blanket to the anvil channel, the female and male element being formed of substantially the same material as the second sheet member and molded one piece therewith.

In a further aspect, the male and female locking elements include fingers.

IN THE DRAWING

In the drawings, preferred embodiments of the present invention are illustrated wherein like parts are designated with like reference numerals. These drawings are diagrammatic and actual parts may differ from the drawings in scale and shape.

Figure 1:
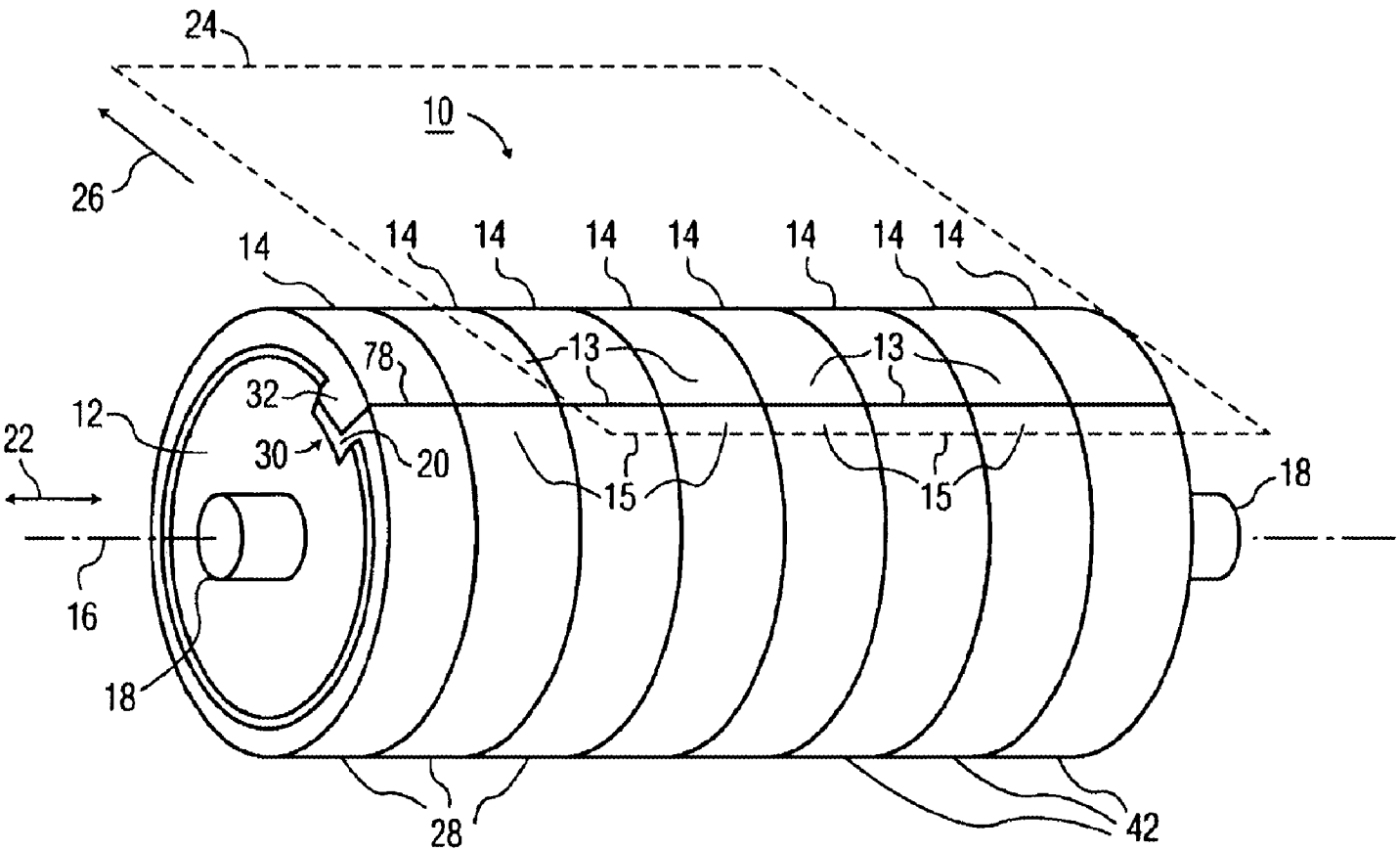
FIG. 1 is a perspective view of a blanket and anvil assembly illustrating an axial array of blankets attached to an anvil according to an embodiment of the present invention.

In FIG. 1, assembly 10 in the present preferred embodiment comprises a typical steel circular cylindrical anvil 12, which is commercially available and which does not form part of the invention, and a linear array of annular anvil covers or blankets 14 wrapped about the anvil. The anvils are part of the die cutting apparatus installed in various factories. The factories purchase replacement blankets for use with such anvils.

The blankets 14 preferably are identical and are according to an embodiment of the present invention. The blankets sometimes are generally designated by the term die cutter blanket. The anvil has a longitudinal axis 16 and a shaft 18 at each end, the shaft being supported by and rotated by the die cutting apparatus (not shown). The anvil 12 has a rectangular in transverse cross section channel 20 which axially extends in directions 22 for the length of the anvil. The channels are typically 2.54 cm (one inch) across normal to their longitudinal axis traversing the anvil parallel to the anvil axis of rotation 16.

The array of blankets 14 covers the anvil 12 outer surface as shown. The assembly 10 is used in an apparatus (not shown) which die cuts work product sheet material 24, such as corrugated paper board and the like (shown in phantom), moving in direction 26 in a plane over the rotating anvil and blankets. The cutting dies (not shown, but shown for example in U.S. Pat. No. 6,435,069 incorporated by reference in its entirety herein) penetrate somewhat into the blanket material outer work surfaces 28 during the cutting process. However, other dies do not necessarily penetrate into the work surface 28. These other dies, for example, compress the work material to form creases which form fold lines or hinges for the final work product.

The blanket material of layer 38 is resilient, but over a period of time exhibits wear at the die areas impacting the blanket. Excessive wear of the prior art blankets occurs at the interlock region at the anvil channel causing premature blanket wear. This wear is reduced by the blanket 14 of the present invention.

Each blanket 14 is secured at its respective blanket ends 13, 15 to the anvil 12 by a preferably identical interlock 30 attached to the blanket ends. The interlock 30 includes a projection 32 which engages the channel 20. The projection 32 includes male and female portions at the respective blanket ends 13 and 15. The projection 32 prevents the corresponding blanket from rotating about the anvil 12 when in use. The projection 32 is complementary to the channel 20 and is somewhat larger to fit in the channel in friction interference fit, e.g., 1 mm (0.04 inches) larger than the channel transverse width w (FIG. 4) in the circumferential direction about the anvil.

In the prior art, a projection forming an interlock and the sheet portion of the blanket are molded of urethane material and may have a support portion formed by a woven fiberglass or other fibrous material or a metal support liner. See the patents noted in the introductory portion for examples.

In FIGS. 5–8, the blanket 14 is formed with a plurality of interlocking male fingers 34 and female fingers 36 which are complementary configured generally modified dovetail shapes. Male fingers 34 are on blanket end 13 and female fingers 15 are at blanket end 15. These fingers will be described in more detail below.

The blanket 14 is formed of two layers 38 and 40. Layer 38 is the top layer which has an outer peripheral work surface 28 on which sheet material 24 passes, FIG. 1. Layer 38 is more resilient than layer 40. The outer work surface 28 is engaged by the cutting dies in the die cutting process. Layer 40 is a bottom layer which is adhesively bonded to the layer 38 underside surface 42, FIG. 2, opposite top the work surface 28, forming a top layer recess 41, FIG. 12. The layer 40 is molded first in a first mold. Then this layer is placed in a second mold. The adhesive is placed over the exposed surface of the layer 40 in the second mold. The adhesive used is commercially available to bond polyurethane to polyurethane. One such adhesive is Thixon a trademark of Rhom & Hass and available from this company.

Figure 12:
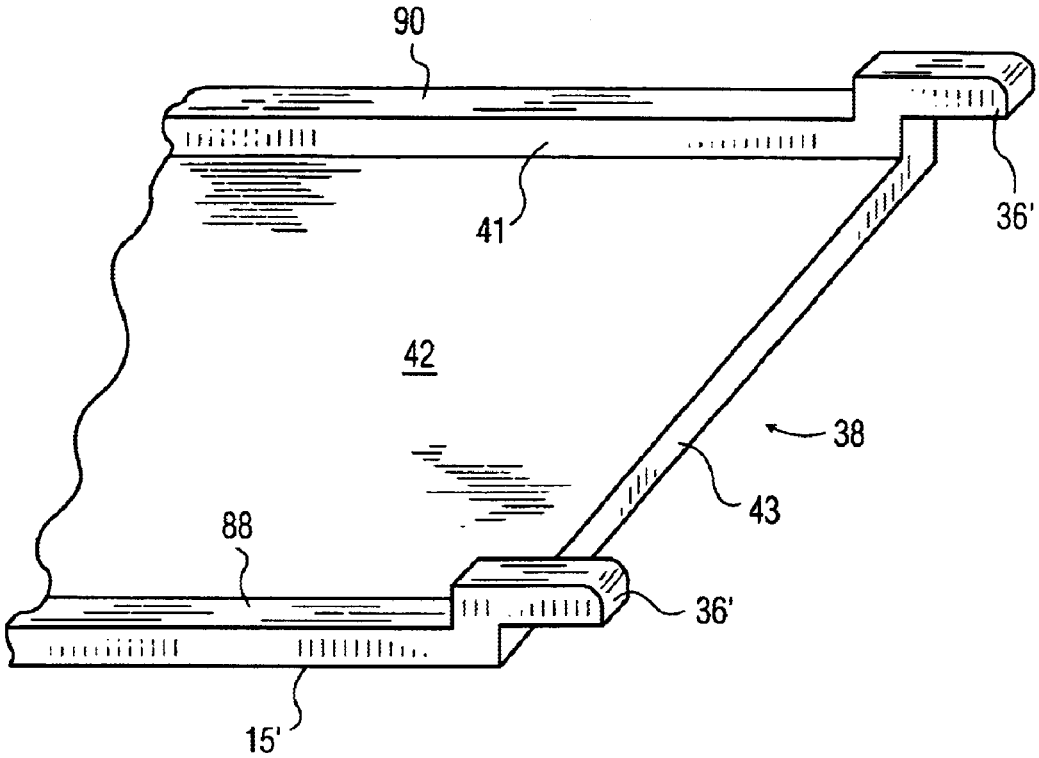
FIG. 12 is an isometric view of the upper layer 38 without the lower layer attached to show the lower layer receiving recess.

The second mold is larger than the first mold. The molten plastic material is then placed in this second mold over the adhesive coated layer 40. The heat from the molten material heats up the layer 40 in this mold and causes the layer 40 to expand. FIG. 12 shows the layer 38 formed by the second mold without the layer 40 present in this figure for ease of illustration of the layer 38. Normally the layer 40 is always attached to the layer 38, which is molded to the layer 40 during its formation.

The layers 38 and 40 are both molded urethane plastic material. Preferably layer 38 is relatively softer than layer 40. Layer 38 preferably has a durometer Shore A value of about 85. Layer 40, which is beneath and on the underside surface 42 of the layer 38 opposite the outer peripheral work surface 28, is harder. Layer 40 preferably has a durometer Shore D value of about 60 to 70. The interface surface 44 of the layer 40 and surface 42 of layer 38 (FIG. 4) are sanded to roughen these surfaces prior to joining. The sanding enhances adhesion of these surfaces with a bonding agent such as an adhesive (not shown). A commercially available adhesive (not shown) is applied to these surfaces to bond the layer 40 to the layer 38.

The layer 38 when molded to layer 40 is formed with a rectangular recess 41, FIG. 12. This recess results from the layer 38 flowing about the layer 40 during molding including the edge regions. The upper layer 38 is flowed about the longitudinal edges of the lower harder layer 40 to minimize manufacturing steps. To provide uniform thickness, the longitudinal edges are trimmed in a later final finishing step to provide uniform blanket widths for the various fabricated blankets. If the harder lower layer 40 were allowed to extend to the edges of the finished blanket, it would need an additional trimming step to provide a uniform width as it is difficult to mold blankets with a desired uniform width.

The recess 41 thus is not formed in a separate step since the layer 38 is molded to the layer 40 and is not molded separately from the lower layer 40. The recess 41 extends from end 13 to end 15 of the layer 38 and terminates at end edge 43 at female end 15 and at the opposite male edge 45 at end 13, FIGS. 5, 6 and 12. The recess 41 (FIG. 12) thus forms an elongate rectangular channel in the layer 38 as formed by bonded layer 40. The surface 42 terminates at linear transverse edges 43 and 45. The edges 43 and 45 are planar and normal to the surface 42. These edges also are normal to the longitudinal length dimension of the layer 38 (and layer 40 attached thereto) extending from left to right in the drawing figure of FIG. 12. As mentioned, the longitudinal edges are finally formed by a finishing trimming step.

Figure 11:
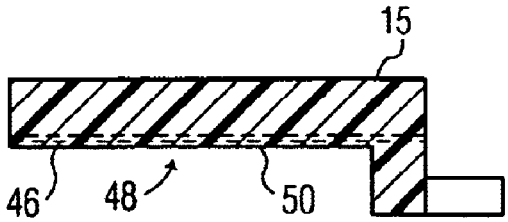
FIG. 11 is a sectional elevation view of a portion of a blanket in accordance with a further embodiment of the present invention.

In an alternative preferred embodiment, in FIG. 11, blanket 48 is molded with a conventional woven sheet fiberglass fabric 46 encapsulated within the blanket 48 material or with other fabric as used in the industry. Blanket 48 is molded of a thermoset polyurethane material such as the material used to fabricate the blanket 14 top layer 38. The fabric 46 preferably is formed of fiberglass fibers and is molded with the blanket 48 at the bottom surface 50. The fabric may extend into the end region adjacent to the fingers, such as fingers 36 at the female end 15 and at the male end (not shown). In further embodiments, the fabric may be molded into the blanket material interior.

The layers 38 and 40 are molded polyurethane which is a good material for a die cutting blanket. This material has high cut and tear resistance and has healing properties once it is cut. These properties permits repetitive cutting at the same region without significant degradation of the material. The outer layer 38 is preferably TDI-polyester prepolymer such as Airthane® PST-90A, a polyurethane distributed by Air Products and Chemicals, Inc. The outer layer 38 should have good cut and tear resistance. It may also have a durometer of about 85 shore A, as noted above, and which may be in the range of about 85–92 Shore A. This material is commonly used in this industry.

Layer 40 is harder and has a higher durometer of about 60–70 shore D as noted above. This material is also a molded polyurethane. This bottom layer 40 preferably is fabricated of a polyurethane material that has a lower cure temperature, higher tensile strength, lower elongation break, and higher flex modulus than the top upper layer 38.

Figure 2:
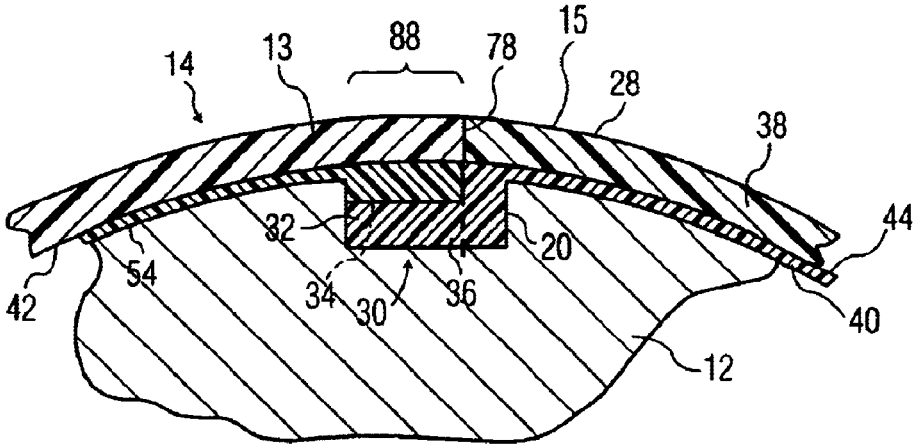
FIG. 2 is a fragmented sectional elevation view of the assembly of FIG. 1 through one of the blankets showing the engaged interlocking fingers of the blanket.
Figure 3:
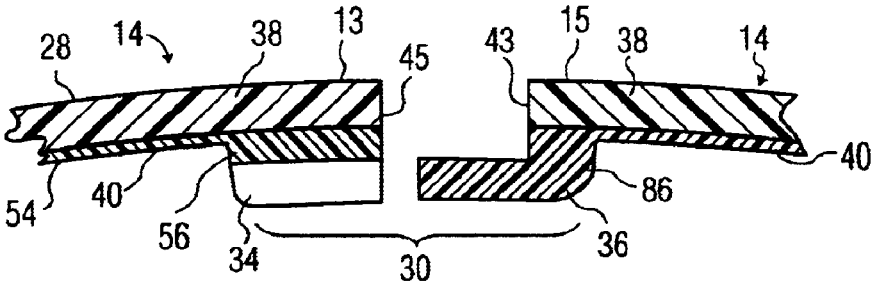
FIG. 3 is a view similar to that of FIG. 2 but showing the blanket ends separated.
Figure 4:
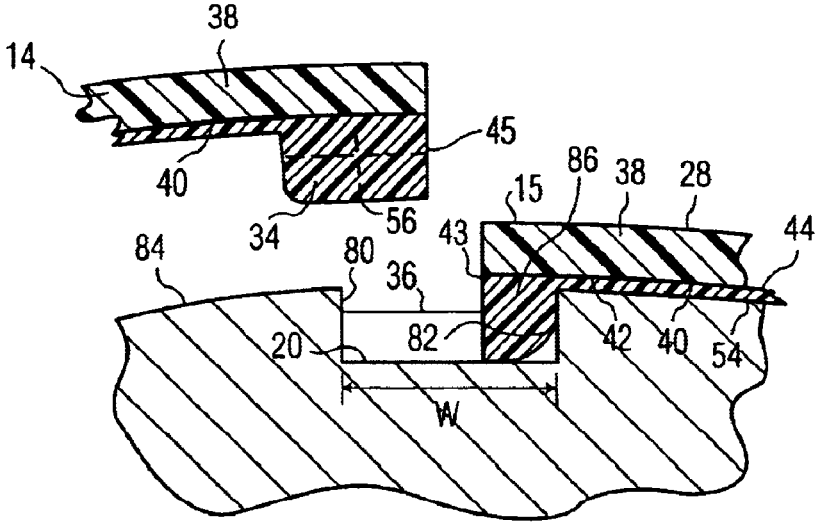
FIG. 4 shows an intermediate step wherein the female end of the blanket is inserted in the anvil channel and the male end is about to be inserted into the channel and interlocked with the female end.

In the alternative, a fiber glass layer may be encapsulated within a lower layer 40 of material in the embodiment of FIGS. 2–4, such as Royalcast 33153 available from Uniroyal Chemical. This material may have a hardness of about 84 Shore D at 68° F. It may have a linear shrinkage of about 2% and a tensile strength of about 10,000 PSI. The curing temperature may be about 120° F.

Figure 10:
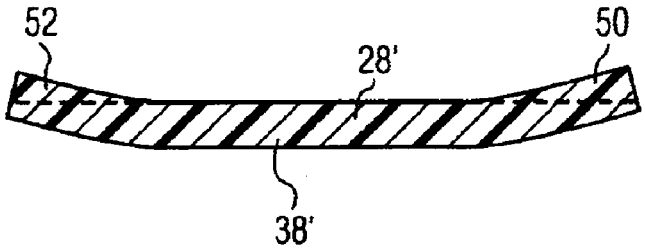
FIG. 10 is a sectional elevation view of a portion of the outer layer illustrating edge curl prior to processing in accordance with an embodiment of the present invention.

In FIG. 10, normally, unless otherwise prevented, the outer top layer 38' when molded and during shrinkage forms an edge curl 52, 52' on outer work surface 28'. This curl is undesirable as it interferes with the use of the blanket for die cutting which requires a linear surface in the cutting regions. Also the exterior finish of surface 28' has undesirable cosmetic blemishes (not shown) which commercially detract from its appearance. In the prior art, the surface 28' is ground to make the blanket of uniform thickness and also to remove the surface blemishes, which are attributed to excess release material coated on the mold inner surfaces. These blemishes are only cosmetic and do not affect the structural integrity of the layer, but are unsightly. The grinding is an additional step, but does not address the high stresses of the material which is also undesirable. These stresses make installation of the blanket on an anvil more difficult. When using a steel liner instead of the lower layer or fabric which is flexible and stretchable, the steel does not change significantly during the molding process and introduces stresses in the molded material which make it difficult to install the blanket on the anvil.

Figure 9:
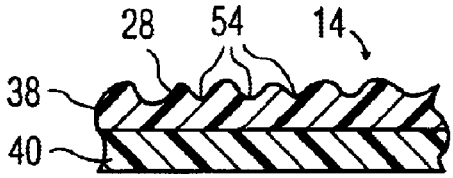
FIG. 9 is a fragmented sectional side elevation view through a blanket portion according to an aspect of the present invention; FIGURE is a fragmented top perspective view of the blanket ends interlocked with a portion shown in section.

In a preferred embodiment, the mold forming the outer layer 38' outer surface 28' is shot peened at 100 PSI with steel balls preferably #4 shot, S-780, 20 mm diameter balls (0.78 inches) followed by 60–80 glass shot of about 15–20 mm diameter balls (0.6–00.8 inches diameter) (shot not shown). The glass shot removes sharp burrs on the metal peened surface. The shot peen process for providing shot peen surfaces on various materials is standard in this industry, but has not heretofor been used on molds for forming urethane blankets. The steel shot peen of the mold surface 28 results in the blanket layer 38 having a surface 28, FIG. 9, with indentations 54 having peaks and valleys. The roughened surface on layer 38 prevents formation of blemishes.

The molding of layer 38 to the lower layer 40 results in heating of the lower layer by heat transfer from the molten upper layer in the mold. The lower layer 40, which is harder and stronger material than upper layer 38, shrinks more than the upper top layer 38 during curing. Surprisingly, this difference in shrinkage apparently results in reduced stress in the overall blanket structure not otherwise anticipated. These layers act somewhat as a bimetal element. The lower layer being stronger results in the reduced stress during shrinkage during cooling and is what mimimizes generating the edge curl.

Thus the layer 38 so processed is improved over the prior art layers in that the thickness of the material throughout remains uniform without grinding as in the prior art. Also the stress is reduced and which stress reduction does not occur with grinding. The reduced stress facilitates installation of the blanket on the anvil. The surface indentations on layer 38 may vary from the dimensions given and which may be determined empirically for a given material. This roughened outer surface eliminates the prior art grinding of this surface of the outer layer to remove blemishes. This eliminates an extra step resulting in a lower cost product and which at the same time exhibits improved properties.

Figure 5:
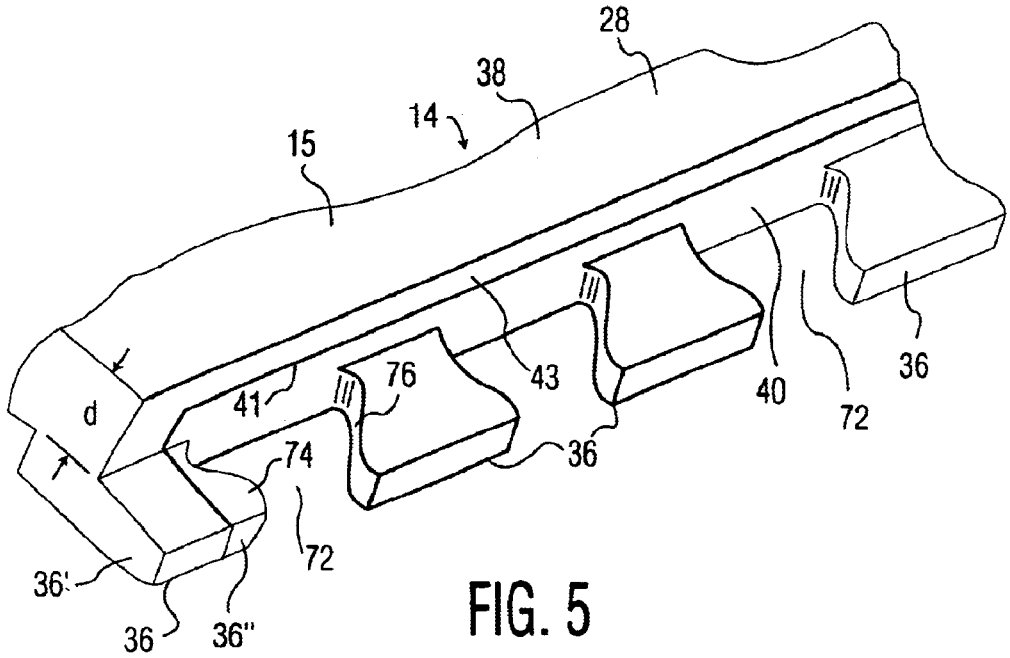
FIG. 5 is an end fragmented perspective bottom view of the female finger end of the blanket
Figure 6:
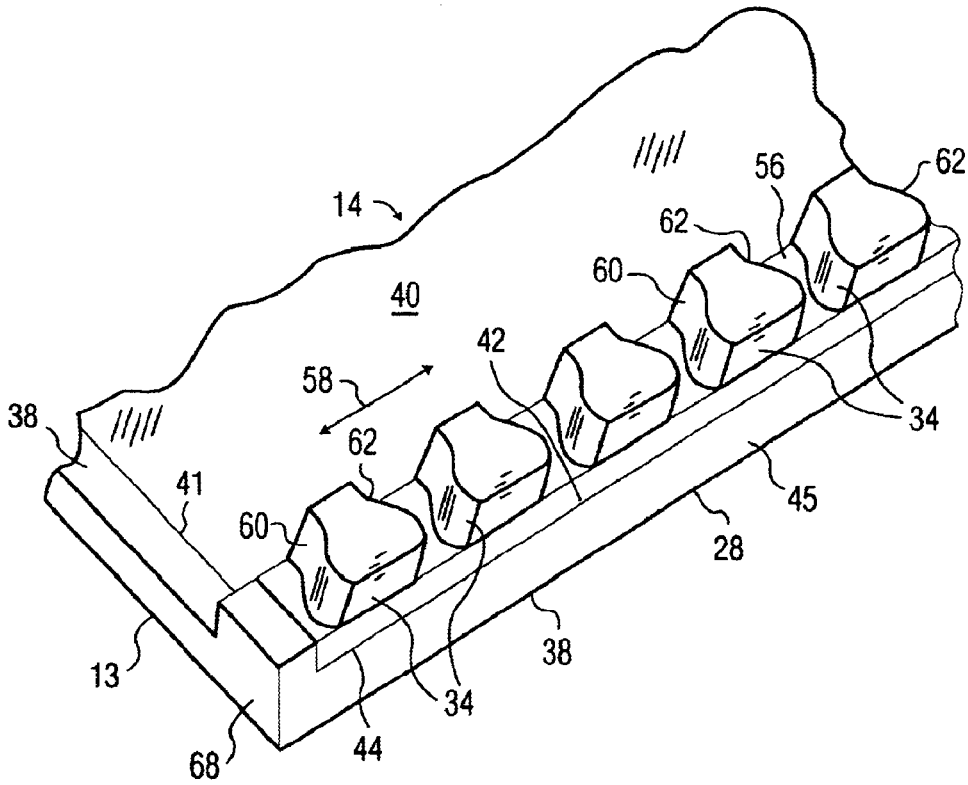
FIG. 6 is a perspective fragmented bottom view of the male finger blanket end of one of the blanket.
Figure 7:
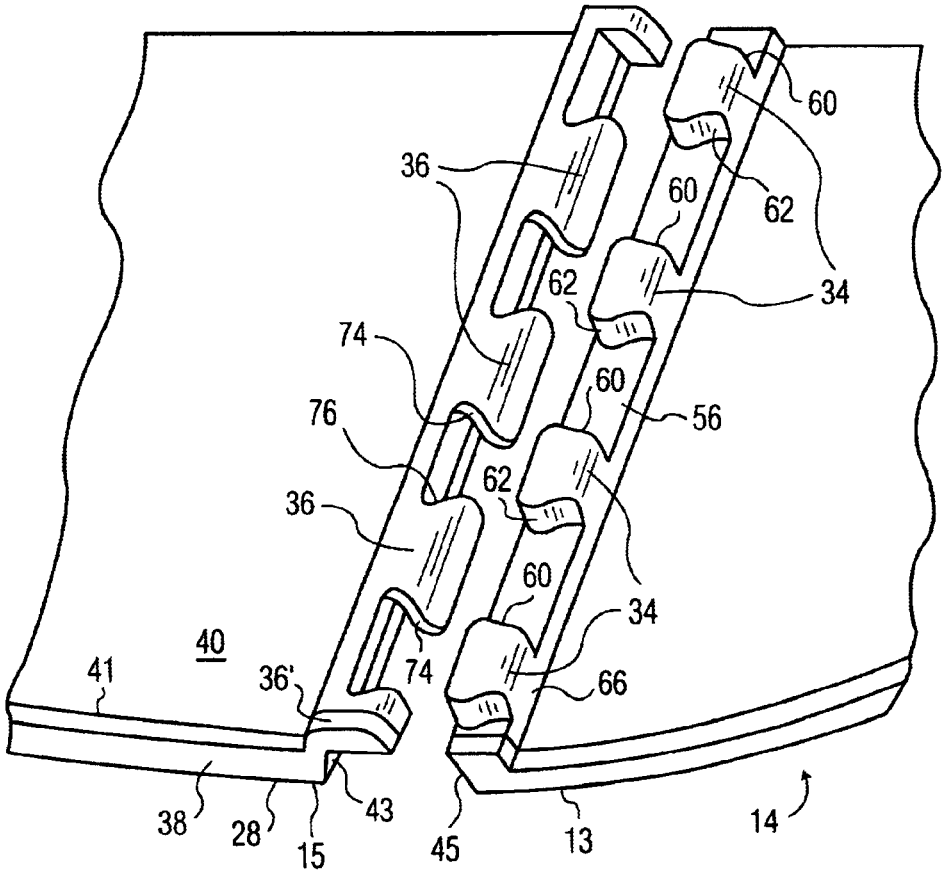
FIG. 7 is a bottom perspective view of the blanket ends of FIG. 7 in spaced relation.
Figure 8:
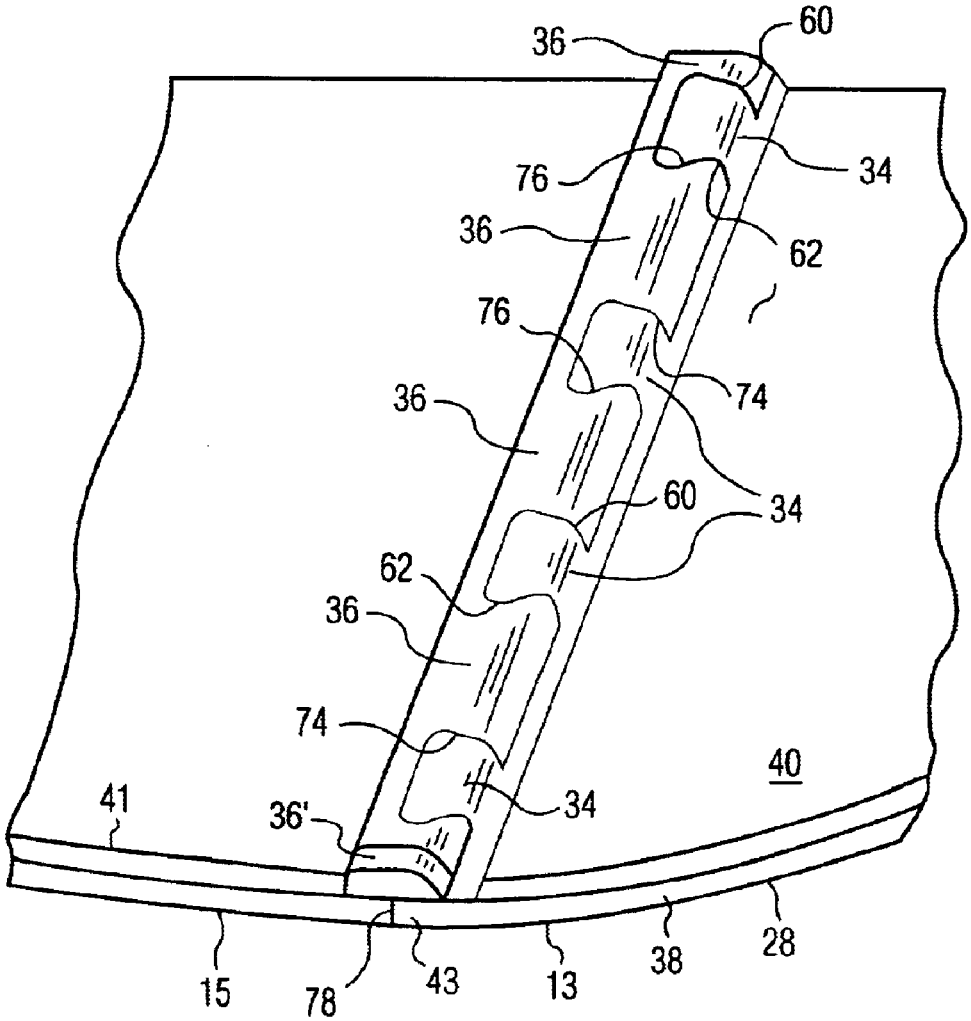
FIG. 8 is a perspective fragmented bottom view of the anvil blanket ends of FIG. 7 with their fingers interlocked.
Figure 13:
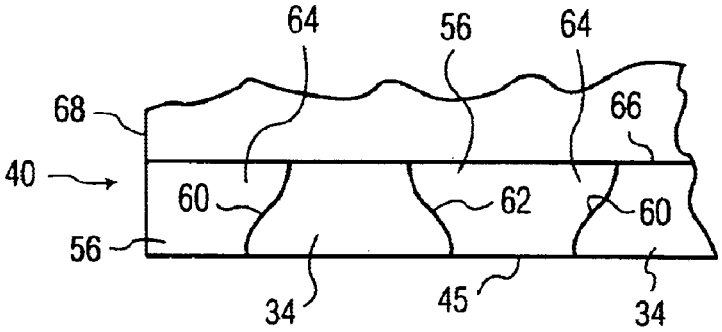
FIG. 13 is a fragmented bottom plan view of a portion of the male fingers.

In FIGS. 5–8, the fingers 34 and 36 are at the blanket ends 13 and 15, respectively. The male fingers 34, FIGS. 3 and 6, are secured to a rectangular ridge or plateau 56 formed in the layer 40. The plateau 56 extends across the width of the blanket in directions 58. The male fingers 34 are modified dove tail in shape in plan view in that the side walls are somewhat S shaped. In FIG. 13, male finger 34 has two opposite side walls 60, 62 which are S shaped and are in mirror image relation. The fingers 34 extend equally spaced from each other in an array across the plateau 56 from edge to edge of the plateau as shown. The space 64 between the male fingers form receptacles for the female fingers. The female fingers 36 engage the space 64 between adjacent male fingers. The female fingers 36 have side walls complementary to the shape of the male fingers. The male fingers 34 are widest adjacent to the end edge 45 and narrowest adjacent to edge 66 of the plateau 56, FIG. 7.

In FIG. 12, the top layer 38 side walls are formed into longitudinal ridges 88 and 90 on opposite sides of the layer during the mold process. The ridges 88 and 90 terminate at edge 43 in female finger portions 36'. Portions 36' are generally L shaped. In FIG. 5, finger portions 36' cooperate with female finger portion 36" to form a complete female finger 36. Portion 36" is part of the bottom layer 40. The remaining female fingers 36 are formed by bottom layer 40. All of the female and male fingers have respective common profiles in plan and side elevation views as seen in the various figures.

The profiles of the male and female fingers 34 and 36 and their corresponding plateaus from which they depend cooperate to form the projection 32, FIG. 2. The projection 32 fills the channel 20 in the anvil as shown in FIG. 2. The female fingers abut opposite side walls of the channel 20. The Male fingers abut a side wall of the channel 20 on one side of the fingers and the end edge of the female end of the bottom layer 40 at the opposite side of the fingers.

In operation, in FIG. 4, the female end 15 is inserted first into the channel 20. The fingers 36 are longer than the channel width w by about 1 mm as discussed above. This provides interference fit and holds the fingers 36 in the channel. Also, the fingers shrink differently and also may produce additional interference fit between the male and female fingers and the channel, which fit locks the fingers together. There may be 0.4 mm (0.015 inches) interference fit of the fingers to each other and which fit varies among the different fingers due to shrinkage factors. This also locks the fingers together and thus locks the projection 32 in the channel. In addition, the male and female ends together may produce an interference fit of the projection 32 in the channel. Also, the blanket 14 may shrink somewhat and be shorter than the circumferential diameter of the anvil surface. This too causes interference fit of the projection 32 in the channel. These friction fits preclude the need for bolts as in many prior art arrangements. In the alternative, the fingers may interengage but need not interlock. This type of engagement is shown for example in the published application no. US 2002/0189419 noted in the introductory portion. The locking action is provided by friction engagement of the projections with the anvil during insertion and removal from the anvil channel. That is, since the projections need to be inclined somewhat as they are inserted into the anvil channel due to geometry, the projections interfere somewhat with the edges of the anvil channel during insertion requiring some deformation of the projections during insertion. The same deformation would be required for removal of the projections from the channel. The force load of such deformation during any attempts at disengagment of the projections keeps the projections locked in the channel. However, the interengaging fingers may also or in the alternative be in interference fit with each other due to dimensional variations of the fingers due to shrinkage or deliberately. This fit also locks the fingers and projections in the anvil channel. This latter fit may also the only locking action present to lock the projections in the channel.

In FIG. 4, the male fingers are attached to the plateau 56. The depending portion 86 of the female blanket end 15 forms a second plateau. The female fingers are attached to and depend from the second plateau. These elements are all substantially formed by the lower layer 40 material except for the edge regions of the upper layer 38 as shown by ridges 88, 90, FIG. 12. The fingers and plateaus together form the projection 32. Layer 40 is harder than the upper layer. This harder material at the seam 78 region beneath the top layer 38 is less likely to result in flat spots, prolonging the life of the blanket. This harder material has less resiliency than layer 38 and thus the die cutters cutting into the layer 38 at this region do not depress the blanket material as much when the entire projection is softer material, resulting in less wear of the blanket layer 38 at this location. This results in less tendency to form flat spots at this location.

The seam 78 between the end edges 43 and 45 of the blanket 14 being linear thus prevents projecting portions above the plane of the major portion of outer work surface 28. This action occurs with interdigitating fingers at the surface such as may occur in the blankets disclosed in U.S. Pat. No. 4,075,918 and US publication 2002/0189419. As noted, the seam may be non-linear, slight curves, to the extent it does not cause portions of the layer to protrude above the plane of surface 28 to cause flat spots to be generated. That is, the seam may be formed by broad elongated curves that do not project above the outer work surface of the blanket.

Once the female fingers 36 are inserted in the channel 20, the male fingers are inserted substantially vertically into engagement with the female fingers as shown in FIG. 4. This action also may cause some interference fit engagement of the male finger region at the plateau 56 with the anvil at the anvil channel 20 side wall 80 during insertion due to shrinkage of the blanket during curing. This interference also tends to lock the projection 32 in the anvil channel 20.

Various reinforcing layers as shown in U.S. Pat. No. 6,435,069 incorporated by reference herein may also be used as desired according to a given implementation. The linear seam 78 at the work surface 28 tends to prolong the life of the blanket by resulting in less flat spots from forming and less stretching of the blanket due to die cuts impacting powder into the die cuts due to the less resiliency of the blanket at the projection 32 region. Again, this is due to the harder material formed by the fingers in the channel, which harder material is not as resilient as the upper layer 38. The blanket end edges 43 and 45 abut and due to the various shrinkage factors provide a load on each other which also tends to lock the projection 32 in the channel 20. In addition, by molding the layers 38 and 40 and gluing them together, the product is easier to install due to reduced stress.

It will occur to one of ordinary skill in this art that various modifications may be made to the disclosed preferred embodiments without departing from the spirit and scope of the invention. For example the shape of the fingers and the seam may differ from that shown. Also, the manner of attaching the bottom layer to the top layer may also vary from that shown. The disclosed embodiments are for illustration and not limitation. It is intended that the invention is defined by the appended claims.

What is claimed is:

1. A die cutter blanket for use with an anvil having an axially extending channel of a given transverse width dimension in the surface thereof comprising:

a first plastic sheet member having first and second ends, the sheet member for wrapping about the anvil and having an outer peripheral top work surface defined by a longitudinal edge and a transverse edge that is linear across substantially the entire width of the first plastic sheet member;

the first and second ends each having an end surface at and depending from the peripheral work surface at the transverse edge, the first and second end surfaces being arranged to abut to form a seam when the sheet member is wrapped about the anvil; and a plurality of complementary interlocking fingers at the respective first and second ends located in a region spaced from and beneath said outer peripheral work surface at said edges and together forming a composite projection depending from said sheet member for selective interlocking engagement with each other to secure the sheet member to the anvil, said projection for engaging said channel.

2. The blanket of claim 1 wherein the sheet member and fingers are urethane wherein the fingers are one piece molded monolithic with the sheet member.

3. The blanket of claim 1 wherein the fingers on the first end form a female projection portion and the fingers on the second end form a male projection portion and which fingers cooperate to form a single projection, the fingers for interdigitated interlocking in a direction concentric to the peripheral work surface.

4. The blanket of claim 1 wherein the outer peripheral work surface is roughened.

5. The blanket of claim 1 wherein the sheet member outer work surface is formed with a plurality of indentations mimicking a shot peened surface.

6. The blanket of claim 1 including a woven sheet support member mold bonded to the sheet member at a surface opposite the work surface.

7. The blanket of claim 1 wherein the projection is in friction fit with the anvil channel in the channel transverse width direction.

8. The blanket of claim 1 wherein the blanket is formed of a top layer and a bottom layer of urethane, the bottom layer having smaller shrinkage and greater hardness than the top layer to reduce edge curl in the blanket.

9. The blanket of claim 8 wherein the sheet member has a longitudinal length, the projection in the direction of the lehgth has a dimension greater than the channel width dimension.

10. The blanket of claim 9 wherein the projection dimension is about 1 mm (0.040 inches) greater than the channel transverse width dimension.

11. The blanket of claim 1 wherein the fingers are uniformly spaced from the outer peripheral work surface and interlock in an interdigitated configuration.

12. The blanket of claim 1 wherein the sheet member has an underside opposite the outer peripheral work surface, the including a plateau depending from the first end at the underside, a plurality of fingers extending from the plateau a distance spaced from the plane of the underside.

13. The blanket of claim 12 wherein the sheet member has a transverse width dimension and a length dimension, the female first end has a linear plateau forming a projection portion depending from the sheet member and extending across the width dimension of the sheet member, the female fingers extending from the plateau in the length direction in a transverse array along said width direction and forming an L-shaped projection portion.

14. The blanket of claim 13 wherein the male fingers extend from a plateau at a sheet member end and engage the female fingers to form a solid projection with the plateaus depending from the sheet member surface opposite the outer peripheral work surface at said seam.

15. The blanket of claim 1 including a second plastic sheet member overlying the first sheet member, the first and second sheet members having different durometers, the first member forming the outer work surface and the second member forming the projection depending from the end regions of the blanket for engagement with the anvil channel, the second member being formed of harder durometer than the first member.

16. The blanket of claim 15 wherein the end edges of at least the first sheet member abut in use forming a linear transverse seam, the fingers being located beneath and spaced from the seam and form at least a projection portion for engagement with the anvil channel.

17. A die cutter blanket for use with an annular anvil having an axially extending channel of a given transverse width dimension in the surface thereof comprising:

a plastic sheet member having an outer work surface and opposing longitudinal edges forming a first layer exhibiting edge curl at the longitudinal edges and having first and second ends terminating in first and second transverse edges;

a second layer of different plastic sheet material than the first layer having a different greater rate of shrinkage during curing than the first layer and molded to the first layer to minimize the edge curl during the curing of the second layer;

interengaging interdigitating locking fingers molded one piece monolithic and integral with at least one of the first and second layers at the ends of the first and second layers for securing the ends together and for securing the sheet members to the anvil, the locking fingers being located spaced from the outer work surface, the interdigitating configuration of the fingers being arranged to lock the fingers to each other.

18. The blanket of claim 17 including a roughened surface finish that mimics a shot peened surface.

19. The blanket of claim 17 wherein the locking fingers comprise interdigitating mating male and female fingers on the respective first and second ends at said first and second edges spaced from the working surface, the fingers interdigitating interlocking in a direction concentric with the outer work surface.

20. The blanket of claim 17 wherein the locking fingers comprises male fingers on the first end and mating female interlocking fingers on the second end, said fingers being located beneath the plane of the blanket work surface, said work surface forming a seam having a configuration different than said fingers.

21. The blanket of claim 20 wherein the mating fingers form a projection for locking to and insertion in the anvil channel.

22. The blanket of claim 21 wherein the projection is in interference friction fit with the anvil channel.

23. The blanket of claim 21 wherein the projection is arranged to be held to the anvil channel by friction and by the interlocking action of the fingers.

24. A die cutter blanket for use with an annular rotating anvil having an axially extending channel of a given transverse width dimension in the surface thereof comprising:

a first plastic outer sheet member having first and second ends, the outer sheet member for wrapping about the anvil and having an outer peripheral work surface defined by a longitudinal edge which extends about the anvil during the wrapping and a transverse linear edge at each of said first and second ends, the outer sheet member having an inner surface;

a second plastic inner sheet member having first and second ends, the second inner sheet member being attached to the inner surface of the outer sheet member for reinforcing and supporting the outer sheet member on the anvil during die cutting a product on said outer peripheral work surface, the second sheet member being formed of a harder plastic material than said outer sheet member, and a female locking element depending from one of the first and second ends of said second sheet member and a male locking element depending from the other of said first and second ends of said second sheet member, the male and female elements being molded one piece monolithic with the second sheet member and spaced from the outer peripheral work surface for interdigitated interlocking engagement and for securing the blanket to the anvil channel.

25. The blanket of claim 24 wherein the male and female locking elements are interengaging interdigitating fingers which interlock in a direction concentric with the outer work surface.

26. The blanket of claim 24 wherein the first sheet member defines a plane, the male and female locking elements lying in a plane beneath the first sheet member plane.

27. The blanket of claim 26 wherein the locking elements are at the transverse edges of the first and second sheet members, the transverse outer surface edges being linear for forming a linear seam when abutting.

28. The blanket of claim 24 wherein the second sheet member has an inner surface for abutment with the first sheet member inner surface, the second sheet member inner surface being relatively rough as compared to its outer surface engaging the anvil, the second sheet member inner surface being bonded to the inner surface of the first sheet member with an adhesive.

* * * * *

UNITED STATES PATENT AND TRADEMARK OFFICE

CERTIFICATE OF CORRECTION

PATENT NO. : 6,889,587 B2
DATED : May 10, 2005
INVENTOR(S) : Kenneth Ray Neal

It is certified that error appears in the above-identified patent and that said Letters Patent is hereby corrected as shown below:

Column 12,
Line 8, after "the" insert -- blanket --

Signed and Sealed this

Twelfth Day of July, 2005

JON W. DUDAS
*Director of the United States Patent and Trademark Office*